US008872015B2

(12) United States Patent
Truchsess

(10) Patent No.: US 8,872,015 B2
(45) Date of Patent: Oct. 28, 2014

(54) CYMBAL TRANSDUCER USING ELECTRET ACCELEROMETER

(75) Inventor: Julia D. Truchsess, Sandy Hook, CT (US)

(73) Assignee: Avedis Zildjian Co., Norwell, MA (US)

( * ) Notice: Subject to any disclaimer, the term of this patent is extended or adjusted under 35 U.S.C. 154(b) by 0 days.

(21) Appl. No.: 13/595,863

(22) Filed: Aug. 27, 2012

(65) Prior Publication Data

US 2014/0053713 A1 Feb. 27, 2014

(51) Int. Cl.

| | |
|---|---|
| ***G10H 3/00*** | (2006.01) |
| ***G10D 13/06*** | (2006.01) |
| ***H04R 1/08*** | (2006.01) |
| ***H04R 5/027*** | (2006.01) |
| ***G10H 3/14*** | (2006.01) |
| *H04R 19/01* | (2006.01) |
| *H04R 31/00* | (2006.01) |

(52) U.S. Cl.

CPC ..... *G10D 13/06* (2013.01); *H04R 19/016* (2013.01); *H04R 1/083* (2013.01); *H04R 5/027* (2013.01); *G10H 3/146* (2013.01); *H04R 31/00* (2013.01)

USPC ..... 84/723; 84/733; 84/743

(58) Field of Classification Search

USPC ..... 84/723

See application file for complete search history.

(56) References Cited

U.S. PATENT DOCUMENTS

| | | | |
|---|---|---|---|
| 3,509,264 | A | 4/1970 | Green |
| 3,553,339 | A | 1/1971 | Dominguez |
| 3,748,367 | A | 7/1973 | Lamme |
| 4,248,129 | A | 2/1981 | Zildjian |
| 4,353,008 | A | 10/1982 | Dorfman |
| 4,516,428 | A | 5/1985 | Konomi |
| 4,579,229 | A | 4/1986 | Porcaro et al. |
| 5,056,399 | A | 10/1991 | Hornstein |
| 5,125,134 | A | 6/1992 | Morita |
| 5,459,283 | A | 10/1995 | Birdwell, Jr. |
| 5,520,292 | A | 5/1996 | Lombardi |
| 5,710,376 | A | 1/1998 | Weber, Jr. |
| 5,915,289 | A | 6/1999 | Hart |
| 6,093,878 | A | 7/2000 | Hoshino |

(Continued)

FOREIGN PATENT DOCUMENTS

| | | |
|---|---|---|
| FR | 2592979 | 7/1987 |
| GB | 2173031 | 10/1986 |
| JP | H11-184459 | 7/1999 |
| JP | 2009-251477 | 10/2009 |

OTHER PUBLICATIONS

O'reilly et al., "Sonic Nirvana: Using MEMS Accelerometers as Acoustic Pickups in Musical Instruments", Analog Dialogue, Feb. 2009, pp. 1-4. vol. 43-02.

(Continued)

*Primary Examiner* — Christopher Uhlir

(74) *Attorney, Agent, or Firm* — Wolf, Greenfield & Sacks, P.C.

(57) ABSTRACT

In one embodiment, a cymbal system includes a cymbal and a transducer couplable to the cymbal. The transducer has a sound pressure microphone, and a casing hermetically sealing the sound pressure microphone to prevent communication of air pressure differentials into the sound pressure microphone. The cymbal may be a perforated low volume cymbal. In one embodiment, a method for making a cymbal transducer includes sealing a sound pressure microphone in an airtight enclosure, and configuring the sealed sound pressure microphone for attachment to a cymbal.

23 Claims, 3 Drawing Sheets

(56) References Cited

U.S. PATENT DOCUMENTS

| | | | | |
|---|---|---|---|---|
| 6,252,967 | B1 | 6/2001 | Moore et al. | |
| 6,443,736 | B1 | 9/2002 | Lally | |
| 6,610,916 | B1 | 8/2003 | Torrez | |
| 6,632,989 | B2 | 10/2003 | Yoshino | |
| 6,822,148 | B2 | 11/2004 | Yanase | |
| 6,835,887 | B2 | 12/2004 | Devecka | |
| 7,015,391 | B2 | 3/2006 | Tomoda | |
| 7,184,563 | B2 * | 2/2007 | Collins | 381/191 |
| 7,323,632 | B2 | 1/2008 | Wachter | |
| 7,408,109 | B1 * | 8/2008 | Freitas | 84/723 |
| 7,488,887 | B2 * | 2/2009 | Mori | 84/743 |
| 7,507,902 | B2 | 3/2009 | Ludwig | |
| 7,589,275 | B2 | 9/2009 | Arimoto | |
| 7,608,771 | B2 | 10/2009 | Fournier et al. | |
| 7,667,130 | B2 | 2/2010 | Mishima | |
| 7,838,753 | B2 | 11/2010 | Steele | |
| 7,851,687 | B2 | 12/2010 | Chang et al. | |
| 8,063,296 | B2 | 11/2011 | Copeland et al. | |
| 8,497,418 | B2 | 7/2013 | Roderick | |
| 2002/0018573 | A1 | 2/2002 | Schwartz | |
| 2003/0221545 | A1 | 12/2003 | Tomoda | |
| 2005/0039593 | A1 | 2/2005 | Wachter | |
| 2005/0126373 | A1 | 6/2005 | Ludwig | |
| 2005/0145101 | A1 | 7/2005 | Yoshino | |
| 2006/0227984 | A1 | 10/2006 | Sinclair | |
| 2007/0137460 | A1 | 6/2007 | Mori | |
| 2007/0169550 | A1 | 7/2007 | Lally | |
| 2008/0163739 | A1 | 7/2008 | Mori | |
| 2008/0205669 | A1 * | 8/2008 | Michelet | 381/118 |
| 2008/0238448 | A1 * | 10/2008 | Moore et al. | 324/686 |
| 2009/0007754 | A1 | 1/2009 | May | |
| 2009/0022350 | A1 | 1/2009 | Asseily | |
| 2009/0179522 | A1 | 7/2009 | Cappello et al. | |
| 2009/0225021 | A1 | 9/2009 | Ye et al. | |
| 2010/0177516 | A1 | 7/2010 | Chang et al. | |
| 2010/0180750 | A1 | 7/2010 | Steele | |
| 2012/0055318 | A1 * | 3/2012 | Miniaev | 84/731 |
| 2012/0060669 | A1 | 3/2012 | Ryan et al. | |
| 2012/0060670 | A1 | 3/2012 | Truchsess | |
| 2012/0118130 | A1 | 5/2012 | Field | |
| 2012/0144980 | A1 | 6/2012 | Roderick et al. | |
| 2012/0186419 | A1 | 7/2012 | Roderick et al. | |

OTHER PUBLICATIONS

"Traps Drums, Portable Acoustic and Electronic Drums", retrieved from URL: <www.trapsdrumsusa.com>, Apr. 2010.

Korean Patent Application No. 2008-242123, filed on Sep. 22, 2008. English translation.

Korean Patent Application No. 2008-312097, filed on Dec. 8, 2008. English translation.

U.S. Office Action in U.S. Appl. No. 12/966,965, mailed on Dec. 23, 2011.

U.S. Office Action in U.S. Appl. No. 12/966,965, mailed on Jun. 22, 2012.

U.S. Office Action in U.S. Appl. No. 13/232,831, mailed on Jan. 31, 2013.

U.S. Office Action in U.S. Appl. No. 13/436,683, mailed on May 29, 2012.

U.S. Office Action in U.S. Appl. No. 13/436,683, mailed on Nov. 9, 2012.

Notice of Allowance in U.S. Appl. No. 12/966,965, mailed on Apr. 3, 2013.

Supplemental Notice of Allowance in U.S. Appl. No. 12/966,965, mailed on May 13, 2013.

PCT International Search Report and Written Opinion in International Application No. PCT/US2011/051798, mailed on Jan. 17, 2012.

PCT International Search Report and Written Opinion in International Application No. PCT/US2011/051810, mailed on Jan. 17, 2012.

PCT International Search Report and Written Opinion in International Application No. PCT/US2011/062964, mailed on Jan. 17, 2012.

PCT International Search Report and Written Opinion in International Application No. PCT/US2011/062959, mailed on Apr. 4, 2012.

O'Reilly, R. et al., "Sonic Nirvana: Using MEMS Accelerometers as Acoustic Pickups in Musical Instruments", Analog Dialogue 43092, pp. 1-4, Feb. 2009.

Aimi, Roberto Mario, "Hybrid Percussion: Extending Physical Instruments Using Sampled Acoustics", Massachusetts Institute of Technology, Feb. 2007, pp. 1-138; http://opera.media.mit.edu/publications/aimi_phd_thesis_2006_hybrid_percussion.pdf.

* cited by examiner

CYMBAL TRANSDUCER USING ELECTRET ACCELEROMETER

TECHNICAL FIELD

The present disclosure relates generally to electronic musical instruments, and particularly to pickups operative to transduce cymbal vibrations to electrical signals.

BACKGROUND

Cymbals have traditionally been an acoustic-only instrument. For live performance in large spaces or recording sessions, microphones are commonly used to pick up the cymbal sound for subsequent amplification and/or recording, but the desire is to remain faithful to the natural sound of the cymbals. Occasionally, a moderate post-processing effect such as reverb or equalization is applied to tailor the sound of the cymbal as required or desired.

The advent of electronic drum kits has naturally given rise to "electronic cymbals." Like their drum counterparts, these devices are used as electronic "triggers,"—that is, the sound of the "cymbal" itself being struck is not amplified for listening or intended to be heard at all. The prior art "cymbal" (or more accurately, a plastic or plastic-covered replica of a cymbal) of this type is fabricated with an impact sensor, producing trigger signals that initiate playback of pre-recorded or canned "samples" of acoustic cymbal sounds when struck. The "sound" of the electronic cymbal is changed by changing the sample(s) that are triggered by the sensor being struck. While this approach offers advantages of virtually silent operation and "authentic" pre-recorded cymbal sounds, it suffers greatly in "feel" and "expression." Drummers are accustomed to the feel of "stick-on-metal" that a traditional metal acoustic cymbal provides, and the very large range of sound variation achievable by striking an acoustic cymbal in different locations with varying types of strikes, strike force, and striking objects (sticks, mallets, brushes, etc.). Practical, cost-effective sample-triggering schemes are not available for providing the feel and range of expression that drummers are accustomed to with acoustic cymbals.

When, alternatively, a conventional microphone that responds to sound waves emanating from the vibrating acoustic cymbal is used, acoustic feedback and acoustic crosstalk from other instruments and ambient noise that is within range of the microphone become problematic, particularly for musical performances that are conducted at elevated sound volume levels.

A microphone is a specific example of a transducer, which in general is a device that is operative to convert an input signal or stimulus in one form into a corresponding output signal or response in another form. In the case of the microphone, the input signal is air pressure waves (sound), and the output signal is an electrical response signal.

An inexpensive and commonly-available microphone is the electret condenser microphone. Referring to prior art FIG. 1A, the principle components of an electret condenser microphone are a housing 4, a very thin and flexible metallized diaphragm 6, and an electret 10, mounted to a metal back plate 9. The diaphragm 6 forms an airtight seal between the air in cavity 8 and external air with which it is in communication via holes (not shown) in the housing. Air pressure differences (sound) cause the diaphragm 6 to flex, changing the distance between it and the back plate 9, which in turn changes the electrical capacitance between them. This capacitance change can be converted to a useful signal using electronics 11 for subsequent processing, amplification, etc. by well-known techniques.

Another type of transducer is an accelerometer. As the name indicates, an accelerometer measures acceleration, serving to convert accelerative forces to proportional electrical signals indicative of acceleration magnitude. Many types of accelerometers have been devised in the past. The majority of these contain a "seismic proof mass" whose tendency to resist changes in its spatial location (that is, its inertia) can be measured in some way. Capacitive accelerometers measure changes in the capacitance of a capacitor whose two plates are attached (directly or indirectly) to a compliantly-suspended proof mass and to a fixed accelerometer housing, respectively. When the accelerometer's housing is accelerated (moved) along the axis of interest, the proof mass tends to remain stationary due to its inertia, and due to its compliant suspension, the distance between the plates changes in proportion to the accelerative force being applied to the housing, thus changing the capacitance between them and providing an indication of the accelerative force.

FIG. 1B shows an electret microphone 30 that has been modified to operate as an accelerometer. In this case, the housing 32 defines a cavity 33 and contains a thin and flexible metallized diaphragm 34, along with an electret 36 mounted to a metal back plate 38. The modification is by way of an added proof mass 40 that is coupled to the diaphragm 34 to provide the necessary increase in inertia for improving sensitivity to accelerative forces. The electronics 42 may or may not be modified as necessary.

The use of accelerometers as musical instrument transducers is known. However, those that are adequate for such applications are expensive and often require time-consuming and non-scalable customization, severely restricting their use. One problem with the use of existing accelerometers is that the proof mass in conventional accelerometers tends to dampen high frequency response, which contains much of the musical information of interest. The problems are compounded in the case of adding a proof mass to an existing electret microphone. The diaphragm of an electret microphone is absolutely diaphanous—thinner and more flexible than an insect wing. The amount of mass to be added would have to be extremely tiny (the diaphragm itself may only be 4 mm in diameter), and its smallness would make the dispensing and application of a consistent amount of adhesive difficult. This in turn would lead to inconsistency in the sound of the assembled transducer.

OVERVIEW

As described herein, a method for transducing cymbal vibrations includes coupling a hermetically-sealed microphone to the cymbal, and operating the hermetically-sealed microphone to provide an output electrical signal in proportion to the cymbal vibrations.

Also as described herein, a method for making a cymbal transducer includes sealing a sound pressure microphone in an airtight enclosure, and configuring the sealed sound pressure microphone for attachment to a cymbal.

Also as described herein, a cymbal transducer includes a sound pressure microphone, and a casing hermetically sealing the sound pressure microphone to prevent communication of air pressure differentials into the sound pressure microphone.

Also as described herein, a cymbal system includes a cymbal, and a transducer couplable to the cymbal. The transducer has a sound pressure microphone and a casing hermetically sealing the sound pressure microphone to prevent communication of air pressure differentials into the sound pressure microphone

BRIEF DESCRIPTION OF THE DRAWINGS

The accompanying drawings, which are incorporated into and constitute a part of this specification, illustrate one or more examples of embodiments and, together with the description of example embodiments, serve to explain the principles and implementations of the embodiments.

In the drawings.

DESCRIPTION OF EXAMPLE EMBODIMENTS

Example embodiments are described herein in the context of a cymbal transducer using electret accelerometer. Those of ordinary skill in the art will realize that the following description is illustrative only and is not intended to be in any way limiting. Other embodiments will readily suggest themselves to such skilled persons having the benefit of this disclosure. Reference will now be made in detail to implementations of the example embodiments as illustrated in the accompanying drawings. The same reference indicators will be used to the extent possible throughout the drawings and the following description to refer to the same or like items.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

The term "exemplary" when used herein denotes "serving as an example, instance or illustration." Any embodiment described herein as "exemplary" is not necessarily to be construed as preferred or advantageous over other embodiments.

Figure 1A:
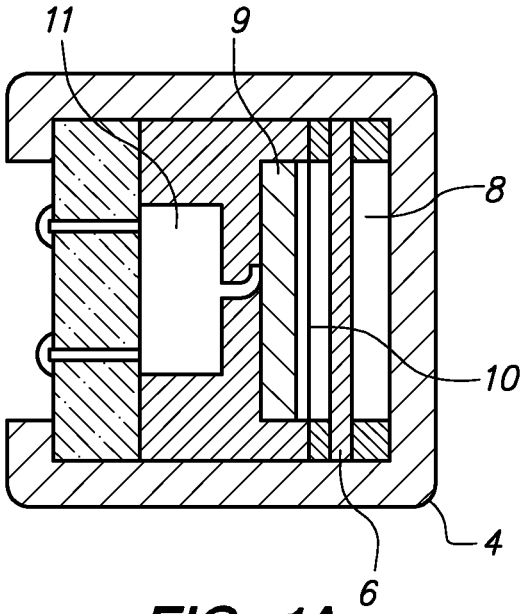
FIG. 1A (PRIOR ART)
FIG. 1A is a cross-sectional diagram of a prior art electret condenser microphone.
Figure 1B:
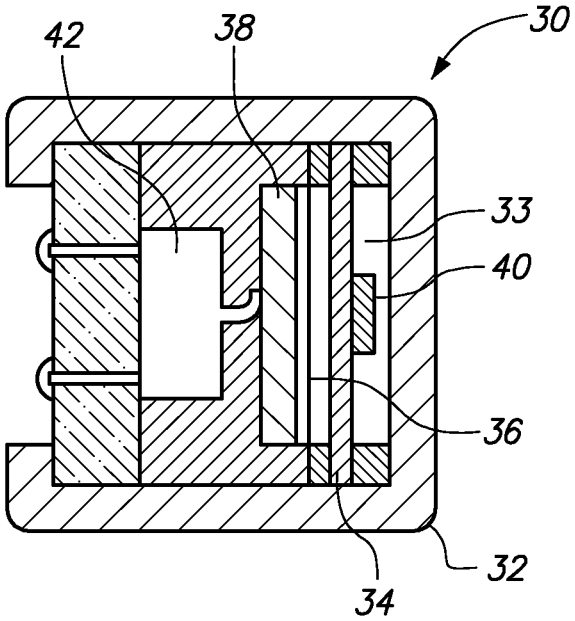
FIG. 1B (PRIOR ART)
FIG. 1B is a cross-sectional diagram of a prior art electret condenser microphone modified to operate as an accelerometer.
Figure 2:
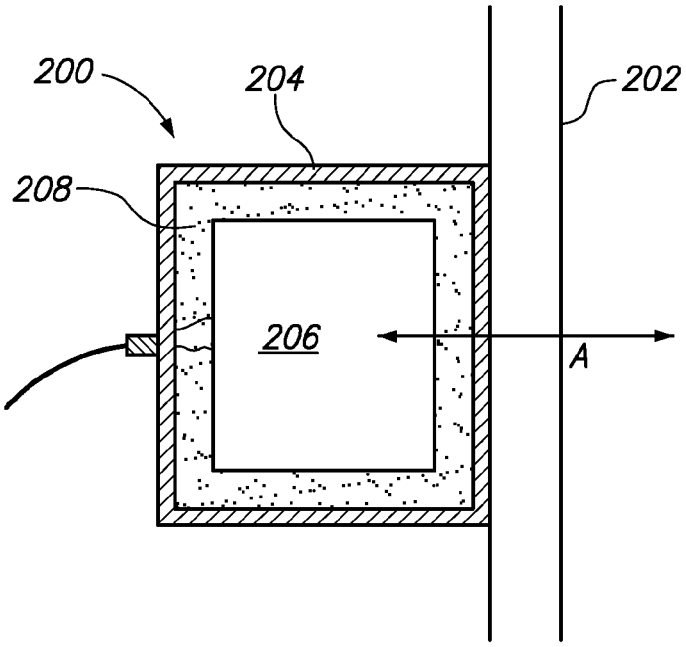
FIG. 2 is a partial cross-sectional diagram of a cymbal transducer coupled to a cymbal in accordance with one embodiment.

FIG. 2 illustrates an accelerative transducer 200 coupled to a metal, acoustic cymbal 202 in accordance with one embodiment. The cymbal 202 can be any of a variety of known metallic cymbals, including but not limited to perforated low-volume type cymbals and hi-hat cymbals. The coupling is intended to faithfully follow motions or oscillations of the cymbal as it vibrates, and may be referred to herein is a mechanically coupling.

In one embodiment, cymbal transducer 200 includes a housing 204 encapsulating a sound pressure microphone such as an electret microphone 206. Encapsulation in this sense should be taken to mean substantially or completely isolating the sound pressure microphone from external air pressure differentials. This is accomplished in one embodiment by hermetically sealing the microphone, such as electret microphone 206, within a casing 208 and housing 204. The casing 208 can be for example rubber or a suitable potting material or resin, or it can be a more rigid material, such as metal. Some considerations to take into account for the encapsulation are that air leakage will result in undesirable microphonic characteristics, while an excessively compliant (non-rigid) mounting will result in some attenuation of accelerative force, particularly at high frequencies. Furthermore, any looseness in the microphone mounting will result in audible and objectionable "buzzing" sounds when vibrated by a cymbal.

By thus encapsulating the electret microphone 206, its principal mode of operation becomes as an accelerometer. Vibrations along the axis of interest normal to the surface of the cymbal and designated A in FIG. 2, produce positive and negative accelerative forces along the axis, and these are detected by electret microphone 206 via deflection of its diaphragm due to the diaphragm's inertia.

Figure 3:
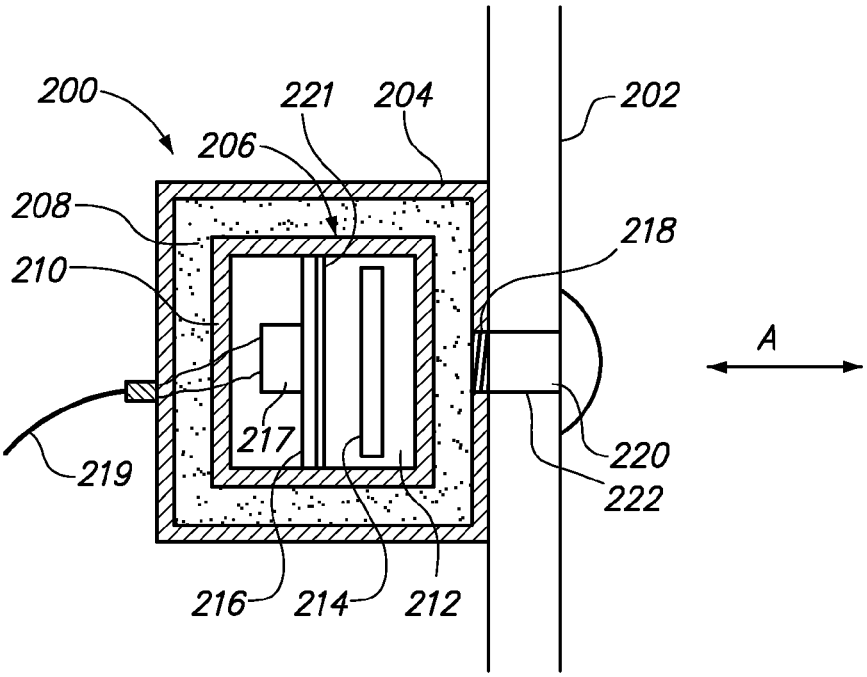
FIG. 3 is a more detailed cross-sectional view of a cymbal transducer coupled to a cymbal in accordance with one embodiment.

FIG. 3 is a schematic cross-sectional diagram of the cymbal transducer 200 and encapsulated electret microphone 206. Generally, electret microphone 206 comprises a microphone housing 210 defining a cavity 212 in which a thin, metallized diaphragm 214 is resiliently mounted for relative motion therein. Diaphragm 214 constitutes one plate of a capacitor, the other plate of which, 216, is fixed within microphone housing 210. An electret 221 for charge storage may be disposed on one of the plates 214, 216. Electrical circuit components generally designated 217 respond electrically to changes in the capacitance between the plates 214 and 216 due to movement of the diaphragm resulting from the vibration-induced accelerative forces, and generate an output signals on conductors 219 indicative thereof.

Electret microphone 206 may be an off-the-shelf component and need not include any additional mass coupled to the diaphragm 214, and little or no modification is necessary to deploy its transducer functionality in this configuration as an accelerometer for detecting the vibrations of cymbal 202. Moreover, because of the absence of such mass, high frequency response is not degraded. Further, configured as an accelerometer, it is insensitive to air pressure variations (sound), and does not suffer from some significant drawbacks of microphones, such as feedback and crosstalk. Thus, configured in this manner, encapsulated electret microphone 206 does not operate as a "microphone" per se, but rather as an accelerometer in which the housing 210 moves along its axis perpendicular to the plane of the diaphragm 216, while the diaphragm attempts to remain stationary and deflects due to its inertia. This inertia, which is small because of the small mass of the diaphragm 216, is nevertheless sufficient to induce the deflection, thanks to the extreme thinness and compliance of the diaphragm.

In one embodiment, cymbal transducer 200 is affixed to cymbal 202 using generally a fastener. In one embodiment, this fastener is of the form of a female configuration in which a threaded hole 218 is provided in housing 204 for threadingly engaging a screw 220 that passes through a hole 222 in cymbal 202. Screw 220 can be made captive to the cymbal to prevent its loss, by permanently affixing it in hole 222, through welding, adhesive, or other means. An alternative arrangement can use a male configuration, with a threaded member protruding from housing 204 for passage through hole 222 and threadingly mating with a nut (not shown), which can also be made captive to the cymbal by welding or the like. Hole 222 can be specially drilled in the cymbal, or, in the case of a conventional low volume perforated cymbal, can be one of the numerous existing perforations of the cymbal. These perforations occur in all the major zones of the cymbal, including the bell thereof, the preferred transducer location in one embodiment.

Figure 4:
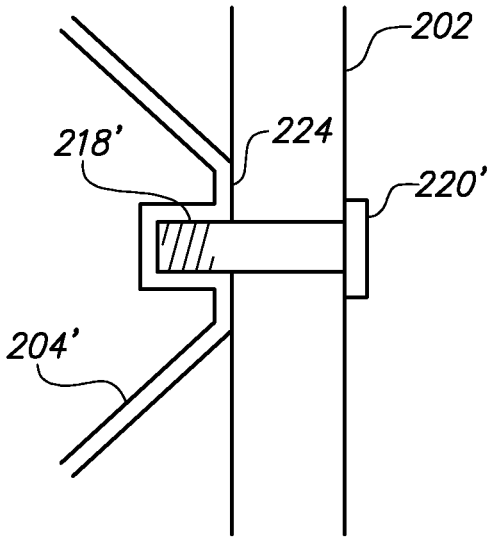
FIG. 4 is a partial cross-sectional view of a cymbal transducer having a truncated cone shaped housing at the region of contact with the cymbal.

It may be desirable in some embodiments to minimize the contact of the cymbal transducer housing with the cymbal, in order to limit or control the nature of the forces that are transferred between the two components. This can be accomplished for example by tapering the housing of the transducer at the interface region of contact 224, as shown in FIG. 4. The housing 204' in this arrangement is in the shape of a cone that is truncated at the region of contact, with a threaded hole 218' formed axially therein. A screw 220', captive to the cymbal, passes through the cymbal to mate with the threaded hole 218' and secure the transducer in the operating position. In this manner, the region of contact 224 between the cymbal transducer and the cymbal is reduced as much as practicable. Intervening components such as washers, dampeners and the like (not shown) may be disposed at the region of contact 224, between the housing and the cymbal 202.

While embodiments and applications have been shown and described, it would be apparent to those skilled in the art having the benefit of this disclosure that many more modifications than mentioned above are possible without departing from the inventive concepts disclosed herein. The invention, therefore, is not to be restricted except in the spirit of the appended claims.

What is claimed is:

1. A method for transducing vibrations of a cymbal, comprising:

mechanically coupling a hermetically-sealed microphone to the cymbal, wherein the hermetically-sealed microphone includes a housing that encapsulates the microphone, and wherein said coupling is such that at least a portion of the housing moves in concert with a point at which the cymbal is coupled to the hermetically-sealed microphone relative to at least one other component of the microphone, resulting in a change in capacitance of at least part of the microphone; and operating the hermetically-sealed microphone to provide an output electrical signal based at least in part on the cymbal's vibrations.

2. The method of claim 1, wherein the microphone is an electret microphone.

3. The method of claim 1, wherein the cymbal is a perforated cymbal.

4. A method for making a cymbal transducer, comprising:

sealing a sound pressure microphone in an airtight enclosure; and configuring the sealed sound pressure microphone for attachment to a cymbal, wherein the sound pressure microphone comprises a diaphragm configured to move relative to at least one other component of the sound pressure microphone, and wherein said relative motion results in a change in capacitance of at least part of the sound pressure microphone.

5. The method of claim 4, wherein the sound pressure microphone is an electret microphone.

6. The method of claim 4, wherein configuring includes providing the sound pressure microphone with a fastener that includes a male or female threaded configuration.

7. The method of claim 6, wherein the fastener includes a component captive to the cymbal.

8. A cymbal transducer comprising:

a sound pressure microphone; and a casing sealing the sound pressure microphone so as to prevent communication of air pressure differentials into the sound pressure microphone the casing being couplable to a cymbal, wherein the sound pressure microphone comprises a diaphragm configured to move relative to at least one other component of the sound pressure microphone, and wherein said relative motion results in a change in capacitance of at least art of the sound pressure microphone.

9. The cymbal transducer of claim 8, further comprising a housing in which the casing and sound pressure microphone are disposed.

10. The cymbal transducer of claim 9, further comprising a fastener for affixing the housing to a cymbal.

11. The cymbal transducer of claim 10, wherein the fastener is a female or male threaded arrangement including a protrusion configured to pass through a hole of a perforated cymbal.

12. The cymbal transducer of claim 11, wherein the fastener includes a component captive to the cymbal.

13. A cymbal system comprising:

a cymbal; and a transducer couplable to the cymbal and including:

a sound pressure microphone;

a casing sealing the sound pressure microphone so as to prevent communication of air pressure differentials into the sound pressure microphone; and a housing in which the casing and sound pressure microphone are disposed, wherein the transducer is couplable to the cymbal such that at least a portion of the housing moves in concert with a point at which the cymbal is coupled to the transducer relative to at least one other component of the microphone, resulting in a change in capacitance of at least part of the microphone.

14. The cymbal system of claim 13, wherein the transducer comprises a fastener configured to, at least in part, couple the transducer to the cymbal.

15. The cymbal system of claim 14, wherein the fastener is configured for affixing the housing to the cymbal.

16. The cymbal system of claim 15, wherein the cymbal is a perforated cymbal, and wherein the fastener is a female or male threaded arrangement including a protrusion configured to pass through a hole of the perforated cymbal.

17. The cymbal system of claim 16, wherein the fastener includes a component captive to the cymbal.

18. The cymbal system of claim 13, wherein the cymbal is a perforated low volume cymbal.

19. The cymbal transducer of claim 9, wherein the housing is configured to minimize a point of contact between the cymbal transducer and a cymbal to which the housing may be coupled.

20. The cymbal transducer of claim 9, wherein the housing is in the shape of a truncated cone at a point of contact with a cymbal to which the housing may be coupled.

21. The cymbal system of claim 14, wherein the housing is configured to minimize a point of contact between the cymbal transducer and the cymbal.

22. The cymbal system of claim 14, wherein the housing is in the shape of a truncated cone at a point of contact with the cymbal.

23. The method of claim 1, wherein the hermetically-sealed microphone comprises a fastener that, at least in part, performs said mechanical coupling to the cymbal.

* * * * *